United States Patent [19]

Nakano et al.

[11] 4,134,524

[45] Jan. 16, 1979

[54] PACKING MEANS FOR COLLARED CLOTHES AND METHOD

[75] Inventors: Akiko Nakano; Hisako Nakano, both of Yokohama, Japan

[73] Assignee: Nakano Shokai, Ltd., Yokohama, Japan

[21] Appl. No.: 851,639

[22] Filed: Nov. 15, 1977

[30] Foreign Application Priority Data

Nov. 15, 1976 [JP] Japan ..... 51/136272

[51] Int. Cl.[2] ..... A41H 5/00; A11H 33/00

[52] U.S. Cl. ..... 223/71; 206/292; 223/37

[58] Field of Search ..... 223/66, 71, 83, 84, 223/37; 206/292, 297, 299

[56] References Cited

U.S. PATENT DOCUMENTS

| | | | |
|---|---|---|---|
| 2,004,362 | 6/1935 | Becht | 223/71 |
| 2,081,356 | 5/1937 | Hiss | 223/71 |
| 3,688,948 | 9/1972 | Roda | 223/71 |
| 3,908,823 | 9/1975 | Smith | 223/71 X |
| 3,989,172 | 11/1976 | Widemann et al. | 223/71 |
| 4,026,444 | 5/1977 | Harjapaa | 223/37 |

*Primary Examiner*—Louis Rimrodt

*Attorney, Agent, or Firm*—Armstrong, Nikaido, Marmelstein & Kubovcik

[57] ABSTRACT

Disclosed are a support sheet for folding, fixing and packing a suit of collared clothes and a method of packing the clothes making use of the support sheet. The support sheet is made of a sheet of paper or a plastic and is provided with a number of slits for fixing respective parts of the clothes to the support sheet in a suitably folded state, thus eliminating the use of clips and, particularly, at least needles which may injure the user's finger and damage the clothes during packing and unpacking, so as to shorten the time and reduce the cost of packing work and to enable the user to easily separate the clothes from the support sheet, as well as to reduce the amount of packing material to be wasted after the use.

21 Claims, 16 Drawing Figures

PACKING MEANS FOR COLLARED CLOTHES AND METHOD

BACKGROUND OF THE INVENTION

The present invention relates to a support sheet for use in packing collared clothes and a method of packing collared clothes making use of the support sheet. More particularly, the invention concerns a support sheet for use in folding, fixing and packing a suit of collared clothes, without any clip and, at least, needles, and a method of folding, fixing and packing a suit of collared clothes making use of the support sheet.

When collared clothes such as shirts are sold, they have to be packed to have an attractive appearance and preserve its self-supporting condition. Also, it is desirable that the portions of the clothes which attract customers' particular attention, for example collars, cuffs and so on, are presented for easy observation by the customers.

To these end, various measures have been taken for folding, fixing and packing clothes, and for preserving the self-supporting condition of the clothes, as well as packing the clothes by means of these measures.

For instance, according to the most popular measure and the method, clothes are folded and fixed to support sheets by means of a number of needles or clips. However, these measure and method have been found inconvenient since therein required are a considerably long time and much personnel expense in the packing work, resulting in a raised cost, as well as a large number of expensive needles or clips which also renders the cost high.

In addition, the use who has purchased the clothes packed in the described manner is obliged to do troublesome and time-consuming work of removing the needles and clips, before he puts the clothes on, which involves a danger of stabbing his fingers by the needles. In a worst case, the user may put the clothes on with some of needles still left on the clothes, so as to be accidentally wounded by those needles.

Further, the packing of the clothes by means of needles or clips involved various problems to be solved, such as disposal of the removed needles or clips, and scratching of the clothes by the needles.

SUMMARY OF THE INVENTION

It is therefore an object of the present invention to provide a support sheet made of paper or a plastic which affords a packing of collared clothes without using needles and clips.

It is another object of the invention to provide a support sheet which affords, not only a folding of the clothes thereon, but also fixing and packing the clothes through retaining the latter by means of a number of slits formed therein, so as to prevent the packed clothes from being collapsed.

It is still another object of the invention to provide a method of packing clothes making use of the support sheet of the kind described.

It is a further object of the invention to eliminate the use of clips and needles, so as to shorten the time and reduce the cost of the packing work.

It is a still further object of the invention to eliminate the use of needles and clips, thereby to protect the user from being injured, and to prevent the clothes from being damaged, when he breaks the packing and when he puts the clothes on.

It is a still further object of the invention to enable the user to detach the clothes from the support sheet more easily and in a shorter time.

It is a yet still further object of the invention to provide a support sheet and a method of packing clothes by means of the sheet, which require, after the removal of the clothes from the support sheet, only to waste the support sheet, thus reducing the amount of materials to be wasted.

DETAILED DESCRIPTION OF PREFERRED EMBODIMENTS

Figure 1:
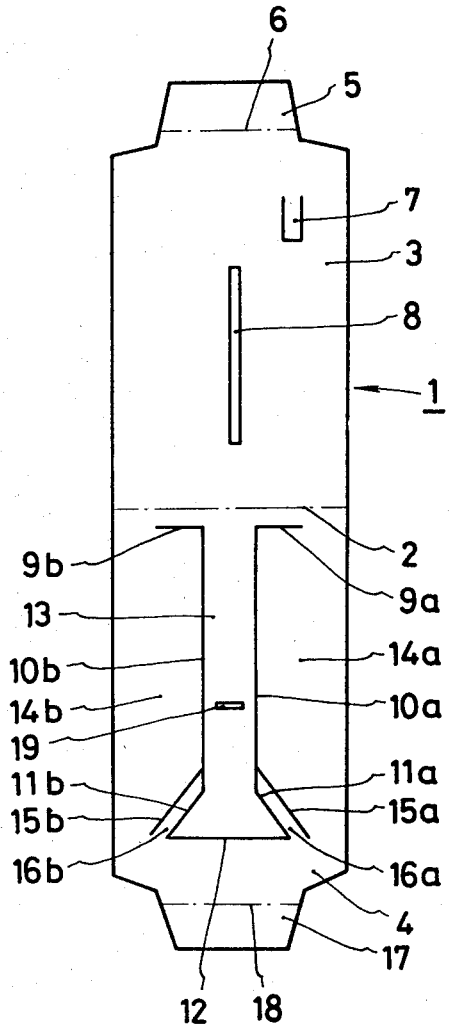
FIG. 1 is a plan view of a support sheet for packing a suit of collared clothes, which is a first embodiment of the present invention.
Figure 2:
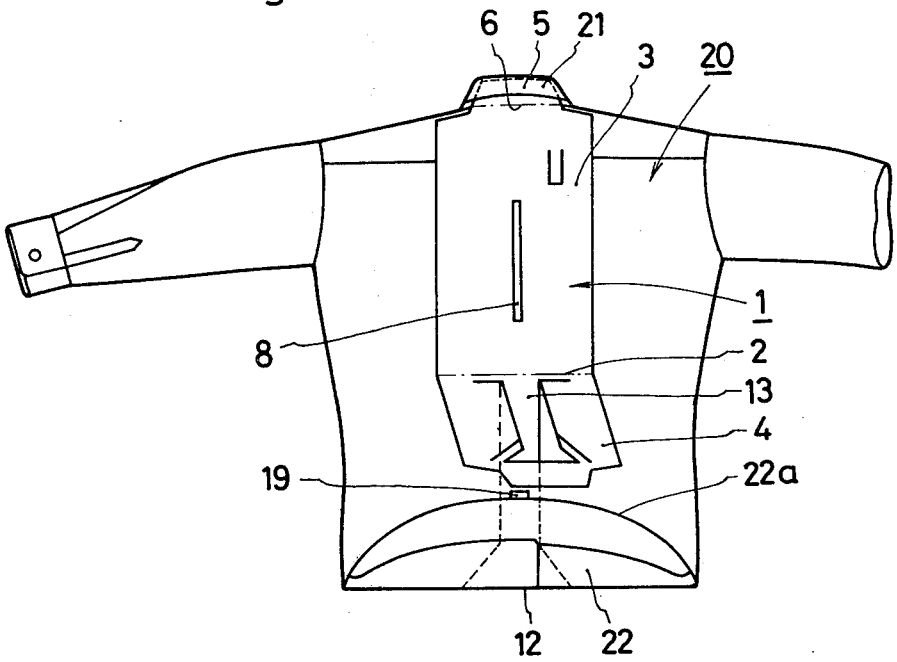
FIGS. 2*a* to 2*g* are plan views of the support sheet of FIG. 1, in successive steps of process of packing the clothes.
Figure 2:
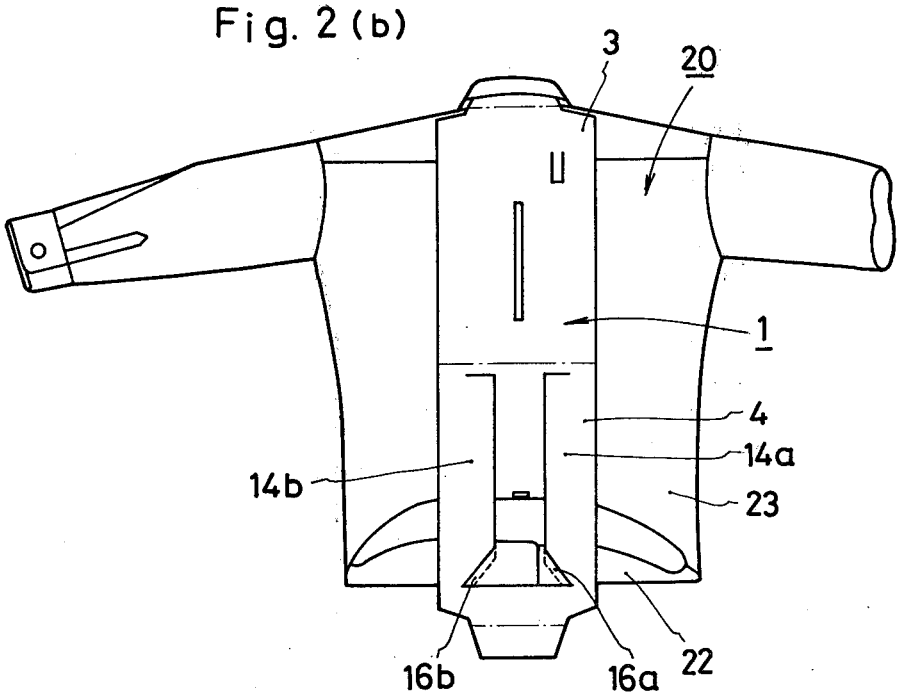
Figure 2:
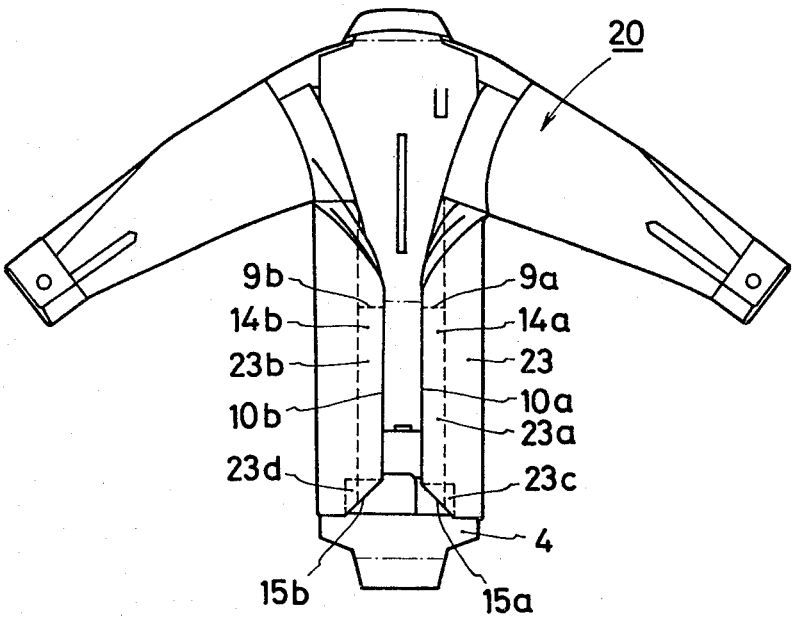
Figure 2:
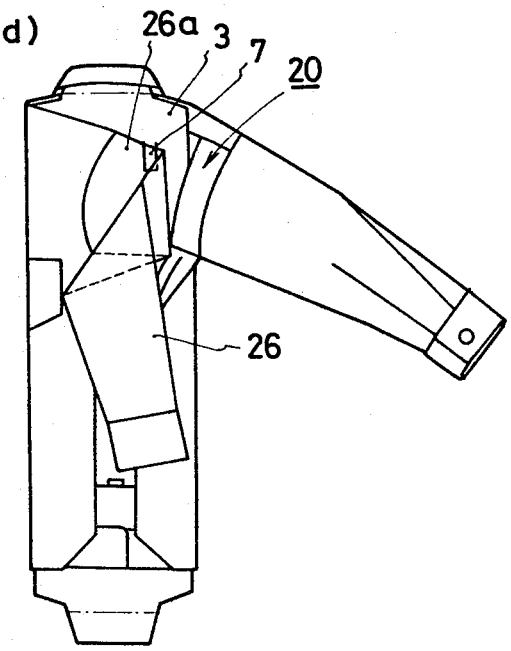
Figure 2:
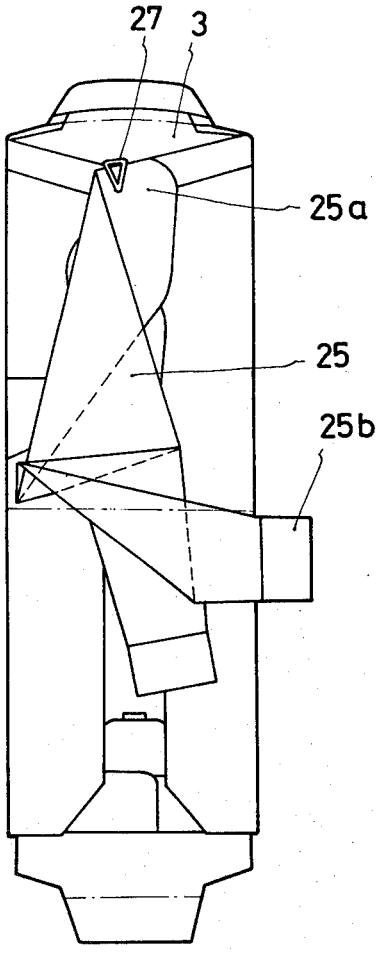
Figure 2:
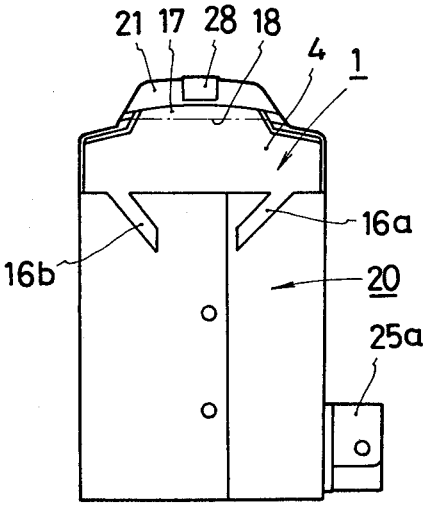
Figure 2:
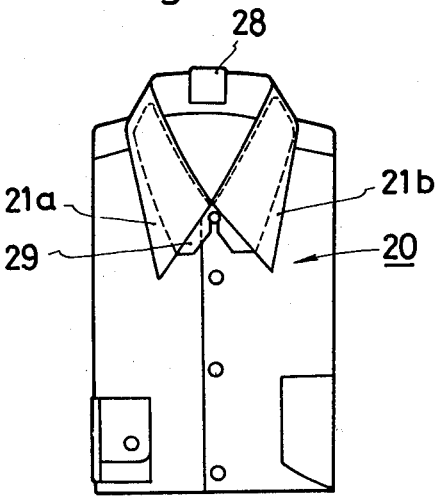

Referring first to FIG. 1 showing a first embodiment of the present invention, a support sheet 1 consists of a sheet of paper or a plastic, and has an elongated shape including an upper half 3 and a lower half 4 demarcated by an intermediate line 2 of folding.

At the upper end of the upper half 3, there is formed a collar-insertion piece 5 adapted to be inserted to the rear neck portion of the collar of a suit of clothes, i.e., into the gap between the collar and the back side of the neck portion of the clothes, so as to fix the collar to the support sheet. The collar-insertion piece 5 can be folded along a line 6 of folding formed at its lower portion so as to lie at an inclination which conforms to that of the collar, with respect to the upper half 3. The upper half 3 is slitted at its right breast portion along three continuous lines, so as to form a tab 7 for fixing the right upper arm portion of the clothes. An elongated vertical slot 8 formed at the central portion of the upper half is provided for confirmation of the correct positioning of the clothes relative to the support sheet, and for preventing the clothes from being displaced laterally on the support sheet. The slot 8 can be dispensed with, if suitable measures are taken for these purposes.

At the central portion of the lower half 4, there is formed a bottom turn-up tab 13, by means of symmetrical slits 9*a*, 9*b*; 10*a*, 10*b*; 11*a*, 11*b*; and 12*b*. Body folding sections 14*a* and 14*b* for folding both side portions of body section of the clothes are formed adjacent to and at both sides of the bottom turn-up tab 13.

The bottom turn-up tab 13 has a lower end 12 by means of which the bottom of the clothes is turned up, while the body folding sections 14*a*, 14*b* have side edges 10*a*, 10*b* round which the side portions of the body section are folded.

Tabs 16*a*, 16*b* for fixing the lower end portion of the bottom of clothes to the lower half 4 are formed adjacent to and under the body folding sections 14*a*, 14*b*, by means of slits 15*a* and 15*b*.

Another collar-insertion piece 17 is formed at the lowermost portion of the lower half 4. When the support sheet 1 is folded at the central line 2 of folding, so as to put he upper and lower halves 3, 4 to lie one on the other, the another collar-insertion piece 17 is inserted to the back portion of the collar, along with the aforementioned collar-insertion piece 5, so as to maintain the folded state of the upper and the lower halves 3 and 4.

As is the case with the first mentioned collar-insertion piece 5, the second mentioned insertion piece 17 is provided with a line 18 of folding, which allows the inclination of the collar-insertion piece 17 in conformity with the inclination of the collar of the clothes.

At almost the central portion of the bottom turn-up tab 13, there is formed a small horizontal slot 19.

When the collar insertion piece 5 of the upper half is inserted to the collar back portion, the folded lower edge of the bottom section of the clothes, folded round the bottom turn-up tab 13 of the lower half 4, comes in alignment with the slot 19, thus providing means for confirming the correct vertical positioning of the clothes relative to the support sheet 1. Also, due to the provision of this slot 19, the back portion of the clothes extending down from the collar back portion is conveniently stretched to provide a good back side appearance of the packed clothes. However, the slot 19 can be dispensed with, if there is provided other suitably means for allowing the operator to turn-up the bottom of the clothes to cause a constant tension in the back side of the clothes to ensure the good appearance. At the same time, if necessary, the slot 19 may be formed in plural, depending on the size of the clothes.

Hereinafter, an explanation will be made as to how to pack the clothes with the support sheet of FIG. 1, with specific reference to FIGS. *2a* to *2g*.

At first, a suit of collared clothes 20 is put with its back side directed upwardly, as shown in FIG. *2a*. The support sheet 1 is laid on the back side of the clothes 20, and the collar insertion piece 5 is inserted to the back side of the collar 21, i.e. into the gap between the collar 21 and the back side of the neck portion of the clothes. The collar insertion piece 5 is folded along the line 6 of folding, so as to lie at an inclination relative to the upper half 3, in conformity with the inclination of the collar 21.

Then, the correct horizontal positioning of the clothes 20 relative to the support sheet 1 is confirmed by means of the slot 8 of the upper half, and, if necessary, the horizontal position of the clothes relative to the support sheet is readjusted to negate the deviation.

Then, the lower half 4 of the support sheet 1 is turned upward, along the demarcation line, so as to lie over the upper half 3, with the bottom turn-up tab 13 remained on the clothes 20. Subsequently, the portion of the bottom section 22 of the clothes, extending downward beyond the bottom turn-up piece 13, is turned up round the lower edge 12 of the bottom turn-up tab 13. Meanwhile, the folded lower edge **22*a* of the bottom 22 is put in alignment with the slot 19 formed in the bottom turn-up tab 13, so as to optimize the vertical positioning of the clothes 20 relative to the support sheet 1, thereby to stretch the back portion of the clothes in vertical direction, at a predetermined tension, for a good back side appearance of the backed clothes. As mentioned before, if the operator can trim the back side of the clothes to be stretched at the predetermined tension, thereby to impart a good appearance, the slot 19 can be neglected and the work for bringing the folded lower edge 22*a* of the bottom into alignment with the slot 19** can be dispensed with.

Referring now to FIG. *2b*, the lower half 4 is turned back to the original posture, and the body section 23 of the clothes 20 is put into contact with the lower half. Then, two tabs **16*a* and 16*b* are turned to the front side of the clothes, i.e., to the downside of the clothes 20 as viewed on the drawings, so that the turned bottom section 22 of the clothes, along with the lower region of the body section 23, is pinched between the tab 16*a* and the lower region of the body folding section 14*a*, and between the tab 16*b* and the body folding section 14*b***.

Turning now to FIG. *2c*, both side portions **23*a*, 23*b* of the body section 23 of the clothes 20 are folded and put into the back of inner sides of the body folding sections 14*a* and 14*b* which are formed in the lower half 4 by slits 9*a*, 10*a* and 15*a*, and 9*b*, 10*b* and 15*b*, respectively, around respective side edges 10*a* and 10*b* of the body folding sections 14*a* and 14*b***. Which one of the two sides is folded earlier does not matter.

Then, two corners **23*c* and 24*d*** which are kept afloat or not supported by the support sheet are folded inward.

Referring now to FIG. *2d*, the left breast section of the clothes 20 is turned upward along the side edge of the upper half 3. Then, the upper arm portion **26*a* of left side sleeve 26 is cramped between the upper half 3 and the tab 7 formed in the latter, and the tab is strongly pressed onto the upper half 3, so as to fix the upper arm portion 26*a* to the upper half 3 of the support sheet 1. The sleeve 26 may be folded so that it may be contained by the area of the upper half 3 of the support sheet 1**.

At the step of FIG. *2e*, the right sleeve 25 is folded along the side edge of the upper half 3, and the upper arm portion **25*a* is fixed to the left sleeve 26, which has been fixed to the upper half, by means of a clip 27. Subsequently, the right sleeve 25 is folded in such a manner tha only the cuff 25*a* or wrist section thereof is extended rightward laterally from the lower half 4 at a position just below the line 6** of folding.

Referring now to FIG. *2f*, the lower half 4 is again turned along the central line 2 of folding, to lie over the upper half 3, and the collar-insertion piece 17 formed at the lowermost portion of the lower half 4 is inserted to the back side of the collar 21 of the clothes 20, so as to lie on the collar-insertion piece 5 of the upper half 3. At this time, the collar-insertion piece 17 is folded along the line 18 of folding, so as to lie at an inclination relative to the lower half 4, in conformity with the inclination of the collar 21. Subsequently, the cuff **25*a* of the right sleeve 25 projecting out from the support sheet 1** is turned to the front side, i.e., onto the breast.

FIG. *2g* shows the front side of the clothes 20 which has been packed in accordance with the steps of FIGS. *2a* to *2f*.

Referring to FIGS. *2f* and *2g*, the collar 21 may be fixed to the collar-insertion pieces 5 and 17, by means of an intermediate plate 28 made of, for example, transparent plastics. In such a case, the intermediate plate can have marks representing the size of the clothes or the like. However, the use of the intermediate plate is not indispensable. For reducing the packing cost, the intermediate plate is preferably eliminated.

Also, as shown in FIG. *2g*, a keeper 29 made of paper or plastics may be retained by the uppermost button, so as to lie under the front portions **21*a*, 21*b* of the collar 21, thereby to make the collar rigidly stand up for a better appearance. However, as is the case with the intermediate plate 28, the use of the keeper 29** is not indispensable. The clothes thus packed is then wrapped by a transparent sack and displayed, for example, in stores.

A second embodiment of the present invention will be described hereinafter, with reference to FIG. 3. The support sheet 31 is made of a sheet of paper or a plastic, and has an elongated shape. The support sheet 31 has an upper and a lower halves 33 and 34 demarcated by an intermediate line 32 of folding. At the upper end of the upper half 33, formed is a collar-insertion piece 35 adapted to be inserted to the back side of the collar of the clothes. The collar-insertion piece 35 is adapted to be bent along a line 36 of folding, so as to line at an inclination conforming to that of the collar of the clothes. The line 36 of folding may be curved to conform to the curvature of the collar of the clothes. Two tabs 37 and 38 are formed at both sides of breast section of the upper half 33, for fixing both sleeves of the clothes to the upper half 33. The tabs 37 and 38 have projections 37*a* and 38*a*, as well as lines 37*b* and 38*b* of folding, respectively. The arrangement is such that the lower regions 37*c* and 38*c* of the tabs 37 and 38 are folded along the lines 37*b* and 38*b*, so as to put the projections 37*a* and 38*a* on the back side of portions 33*a* and 33*b* of the upper half 33, thereby to secure the both sleeves more securely to the upper half 33. Between the tabs 37 and 38, formed is an opening 39 for allowing the operator to easily fix the sleeves to the upper half by means of the tabs 37 and 38.

Another tab 40 provided at the central lower portion of the upper half 33 is for cooperating with the tab 38 in fixing the left sleeve to the upper half 33. An opening 41 formed at the center of the tab 40, i.e., at the breadthwise center of the upper half is for confirmation of correct positioning of the clothes relative to the support sheet 1.

At the center of the lower half 34, formed is a bottom turn-up piece 42 having a shape as illustrated. At both sides of the bottom turn-up piece 42, formed are body folding sections 43 and 44. At both sides of the upper region of the bottom turn-up piece 42, formed are projections 42*a* and 42*b*, for fixing the side portions of body section of the clothes, which are folded around the body folding sections 43, 44 to the lower half 34.

The body folding sections 43 and 44 are formed mainly by slits 43*a*, 43*b*, 43*c* and 44*a*, 44*b* and 44*c*, wherein the upper slits 43*a* and 44*a* are aligned with the horizontal line 32 of folding at the center of the support sheet 31.

At the demarcation line 42*c* by which the bottom turn-up piece 42 is demarcated from the lower half, i.e., the lowermost line of the bottom turn-up piece 42, formed are two projections 45 and 46 projecting beyond the demarcation line 42*c* toward the bottom turn-up piece 42. These projections serve to fix the bottom section of the clothes, which is turned up by the bottom turn-up piece 42, to the lower half 34 of the support sheet. Another collar insertion piece 47 formed at the lowermost portion of the lower half 34 is adapted to be inserted to the back side of the collar of the clothes, along with the collar-insertion piece 35.

The collar-insertion piece 47 is adapted to be bent along the line 48 of folding so as to lie at an inclination in conformity with the inclination of the collar. The line 38 of folding may be curved to conform to the curvature of the collar.

At the upper central portion of the lower half 34, formed is a tab 49 and an opening adjacent to the tab. The tab 49 is for fixing the fore arm portion of the right sleeve of clothes, while the opening 50 is used for an easier fixing by the operator of both side portions of the body section of the clothes, which are folded round the body folding sections 43 and 44, respectively, to the projections 42*a* and 42*b* of the bottom turn-up piece 42.

Figure 3:
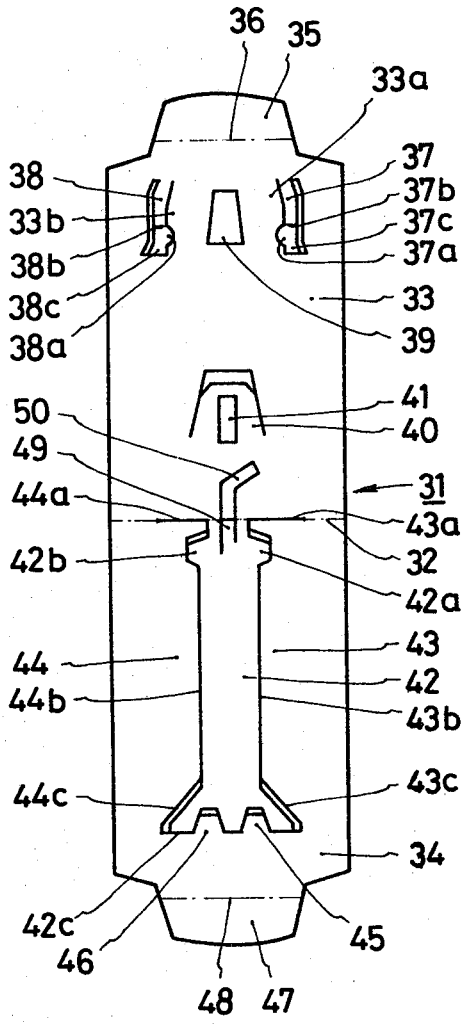
FIG. 3 is a plan view of support sheet for packing a suit of collared clothes, which is a second embodiment of the invention.

Hereinafter, an explanation will be made as to how to pack a suit of collared clothes with the suppor sheet 31 of the second embodiment as shown in FIG. 3, with specific reference to FIGS. 4*a* to 4*b*.

At first, the clothes 20 is put with its back side directed upward, on which laid is the support sheet 31. Then, the collar-insertion piece 35 of the upper half 33 is inserted to the back side of the collar 21 of the clothes, and is bent along the line 36 to lie at an inclination conforming to that of the collar 21.

At this stage, the correct positioning of the clothes 20 relative to the support sheet 31 is confirmed through the opening 41 formed in the tab 40 of the upper half 33. Subsequently, the lower half 34 is turned upward, along the central line 32 of folding preferably until it comes to lie over the upper half 33, so as to remain the bottom turn-up piece 42 on the clothes 20. Then, the bottom section 22 of the clothes is turned up around the lower edge 42*c* of the remained bottom turn-up piece 42. In this turning-up of the bottom, the back side of the collar portion is so adjusted to be stretched at a predetermined tension, so as to impart a good appearance to the back portion of the packed clothes.

Figure 4:
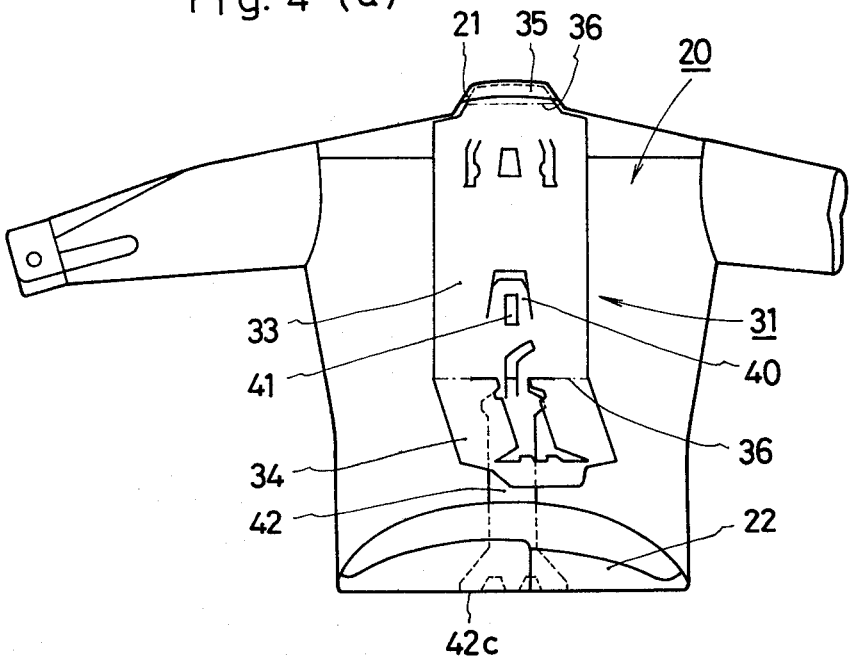
FIGS. 4*a* to 4*g* are plan views of the support sheet of FIG. 3, in successive steps of packing the clothes.
Figure 4:
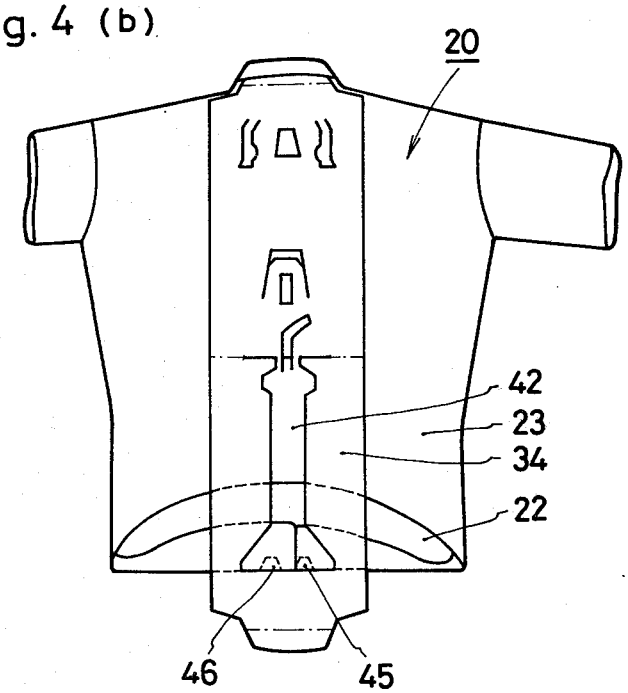
Figure 4:
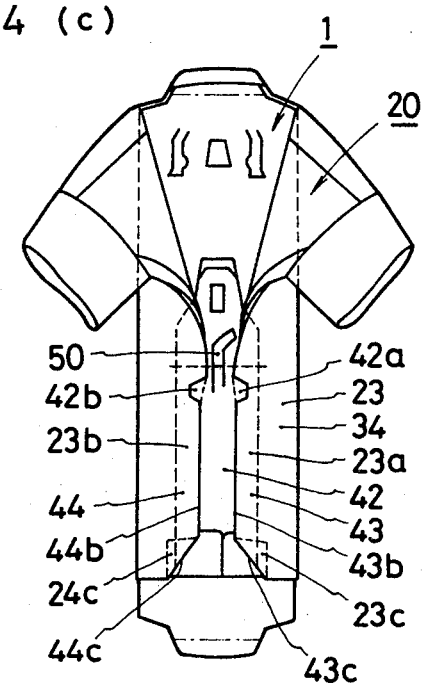
Figure 4:
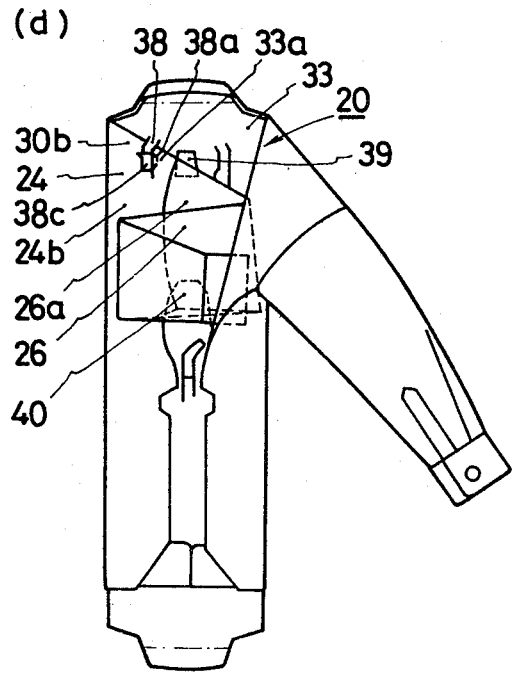
Figure 4:
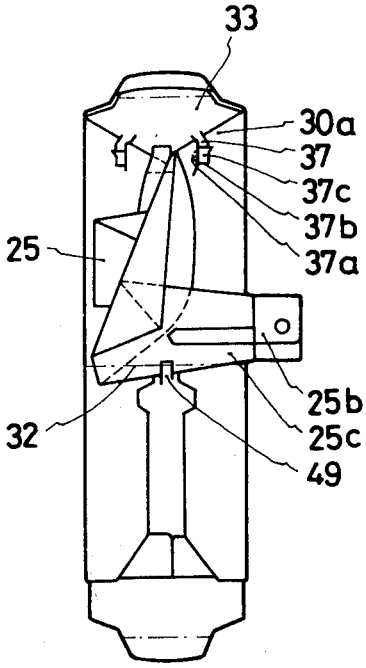
Figure 4:
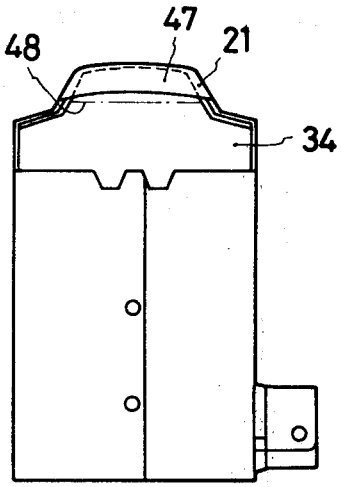
Figure 4:
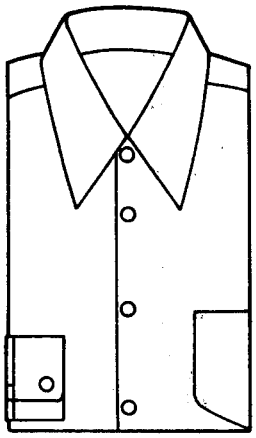

Referring now to FIG. 4*b*, the lower half 34 is stretched to come in contact with the body section 23 of the clothes 20, and two projections 46 and 42 of the lower half 34 are put on the front side of the clothes 20, so that they may fix the folded bottom 22 to the lower half 34, in cooperation with the bottom turn-up piece 42.

Referring now to FIG. 4*c*, both sides 23*a* and 23*b* of the body section 23 of the clothes 20 are folded down to the back side of the body folding sections 43 and 44 of the lower half 34, around the side edges 43*b* and 44*b* of these sections, making use of the opening 50. Which one of the sides 23*a* and 23*b* is folded earlier does not matter. Subsequently, the lower corners 23*c* and 24*c* are folded around the edges 43*c* and 44*c*.

Projections 42*a* and 42*b* formed at both sides of upper region of the bottom turn-up piece 42 are then turned to the front side, so as to fix the body folding sections 43 and 44, as well as the bottom turn-up piece 42.

Turning to FIG. 4*d*, the left side portion 24*b* of the breast section 24 of the clothes 20 is turned upward along the left side edge of the upper half 33, so as to cramp the left shoulder 30*b* by the tab 38. Then, the lower portion 38*c* of the tab 38 is bent along the line 38*b* of folding, while the projection 38*a* is pressed into the lower side of a portion 33*c* of the upper half 33 adjacent to the tab 38, thereby to fix the left shoulder 30*b* to the upper half 33. This work will be facilitated by the use of the opening 39.

Meanwhile, the lower portion of the upper arm region 26*a* of the left sleeve 26 is cramped and fixed by the tab 40 provided at the central lower portion of the upper half 33, and the left sleeve 26 is suitably folded, as illustrated, to be within the area of the upper half 33.

The procedure of folding and fixing the left side 23*a* of the body portion 23 as explained with reference to FIG. 4*c* and the procedure of fixing and folding of the left sleeve 26 as explained with reference to FIG. 4*d* may be reversed.

In the step of FIG. 4*e*, the right sleeve 25 is folded along the side edge of the upper half 33, while the right shoulder 30*a* is fixed to the upper half 33, by means of the tab 37 and the projection 37*a* formed on the lower region 38*c* of the tab 37, in the similar manner as the left shoulder 30*b* in the step of FIG. 4*d*. Then, the fore arm portion 25*c* is fixed by the tab 49, and the right sleeve 25 as a whole is suitably folded in the manner, for example as illustrated. At this stage, the cuff 25*b* is made to project rightward laterally from the upper half 33, at position just above the line 32 of folding.

In the step of FIG. 4*f*, the lower half 34 is turned again along the central line 32 of folding of the support sheet 31, to lie over the upper half 33, and the collar-insertion piece 47 of the lower half 34 is inserted to the back side of the collar 21, so as to be superimposed to the collar-insertion piece 35 of the upper half 33. The collar-insertion piece 47 is bent along the line 48 of folding, so as to lie at an inclination conforming that of the collar 21. Finally, the cuff 25*a* of the right sleeve extending laterally from the support sheet 21 is folded over the front side of the clothes, thus completing the packing of the clothes by means of the support sheet as shown in FIG. 4*g*. The packed clothes are then wrapped, for example, with sacks and displayed in stores.

What is claimed is:

1. A support sheet for folding and fixing collared clothes, comprising upper and lower halves which are adapted to be laid substantially one over the other when said support sheet is folded along a central line of folding, said upper half having an upper end collar-insertion piece adapted to be inserted to the back side of a collar of said clothes, while said lower half is provided with a bottom turn-up piece pivotally connected at one end to said lower half adjacent said central line of folding and centrally positioned on said lower half, an end opposite said pivotally connected end being adapted for turning the bottom section of clothes up around, and two body folding sections formed adjacent to and at both sides of said bottom turn-up piece, around which both side portions of the body section are to be folded.

2. A support sheet as claimed in claim 1, characterized by being made of a sheet of paper or plastics.

3. A support sheet as claimed in claim 1 having at least one tab for fixing one of the sleeves of said clothes.

4. A support sheet as claimed in claim 1, characterized by comprising a tab for fixing the folded bottom onto said lower half.

5. A support sheet as claimed in claim 1, characterized by comprising a tab for fixing the body section of the clothes folded around said body folding sections and bottom section of the clothes turned up around said bottom turn-up piece.

6. A support sheet as claimed in claim 1, characterized by comprising a collar-insertion piece formed at the lower end of said lower half.

7. A support sheet as claimed in claim 1, characterized by an opening formed in said upper half for indicating that the clothes and the support sheet are correctly positioned relative to each other.

8. A support sheet as claimed in claim 1, characterized by comprising an opening formed in said lower half for indicating that the lower edge of the bottom of said clothes is correctly positioned in relation with the support sheet and for optimizing the stretching condition of the back portion of the packed clothes down from the neck portion of said clothes.

9. A support sheet for folding and fixing collared clothes, comprising an upper and a lower halves adapted to be laid substantially one over the other when said support sheet is folded along a central line of folding, said upper half having an upper end collar-insertion piece adapted to be inseerted to the back side of the collar of said clothes, while said lower half having a bottom turn-up piece formed at the central lower portion thereof and around which the bottom of said clothes is folded and fixed, and two body folding sections formed at both sides of and adjacent to said bottom turn-up piece around which the both side portions of the body of said clothes are folded and fixed, said support sheet further comprising a keeper adapted to be inserted to the lower side of the front collar portion of said clothes.

10. A support sheet as claimed in claim 9, characterized by being made of a sheet of paper or plastics.

11. A method of packing a suit of collared clothes by a support sheet characterized by comprising the steps of putting a support sheet on the back side of said clothes in stretched or developed state, inserting an upper end of collar-insertion piece of the upper half of said support sheet to the back side of the collar of said clothes, turning up the bottom section of said clothes around a bottom turn-up piece of the lower half of said support sheet, folding and fixing the both side portions of body section of said clothes around body folding sections of said lower half of said clothes, fixing at least one of the sleeves of said clothes by means of a tab formed in said upper half of said clothes, folding the other sleeve of said clothes and then folding said support sheet along its central line of folding to put the upper and the lower halves of said clothes to lie one over the other.

12. A method as claimed in claim 11, characterized in that both sleeves of said clothes are fixed by respective one of two tabs formed in said upper half of said support sheet.

13. A method as claimed in claim 11, characterized in that the bottom portion of the clothes turned up around the lower edge of said bottom turn-up piece is fixed to the lower half of said support sheet by means of a tab formed in the lower half of said support sheet.

14. A method as claimed in claim 11, characterized in that the bottom portion of the clothes turned up around the lower edge of said bottom turn-up piece is fixed by means of projection formed on the lower half of said support sheet.

15. A method as claimed in claim 11, characterized by further comprising the step of inserting a collar-insertion piece formed on said lower half of said support sheet to the back side of the collar of said clothes.

16. A method as claimed in claim 11, wherein the fixing of said sleeve by means of said tab is made by fingers of the operator which are passed through an opening formed in the vicinity of said tab.

17. A method as claimed in claim 11, wherein said fixing of said body portion of said clothes to the lower half of said support sheet is made by fingers of the operator which are passed through an opening formed in the upper half of said support sheet.

18. A method as claimed in claim 11, wherein the correct horizontal positioning of said clothes relative to said support sheet is confirmed, through an opening formed in said upper half of said support sheet, when said upper end collar-insertion piece is inserted to said back side of said collar.

19. A method as claimed in claim 11, wherein the correct vertical positioning of said clothes relative to said support sheet is confirmed and the stretching state of the back side of said clothes down from the neck portion is optimized, through an opening formed in said lower half of said support sheet when said bottom portion of said clothes is turned up around said bottom turn-up piece of said lower half of said support sheet.

20. A method of packing a suit of collared clothes by a support sheet characterized by comprising the steps of putting said support sheet onto the back side of stretched clothes, inserting a collar-insertion piece of the upper half of said support sheet to the back side of the collar of said clothes, turning up the bottom portion of said clothes around a bottom turn-up piece formed on the lower half of said support sheet, folding and fixing both side portions of body section of said clothes around body folding sections formed on the lower half of said support sheet, folding and fixing one of the sleeves of said clothes by means of a tab formed in the upper half of said clothes, fixing the other sleeve to said one sleeve by means of a clip and folding said other sleeve, and folding said support sheet along its central line of folding to put the upper and the lower halves of said clothes to lie one over the other.

21. A method of packing a suit of collared clothes by a support sheet characterized by comprising the steps of putting said support sheet onto the back side of the stretched clothes, inserting a collar-insertion piece formed on the upper half of said support sheet to the back side of the collar of said clothes, turning up the bottom section of said clothes around a bottom turn-up piece formed on the lower half of said support sheet, folding and fixing both side portions of body section of said clothes around body folding sections formed in said lower half of said support sheet, folding and fixing at least one of the sleeves of said clothes by means of a tab formed in the upper half of said support sheet, folding said support sheet along its central line of folding to put the upper and the lower halves of said clothes to lie one over the other, inserting a collar-insertion piece formed on said lower half of said support sheet to the back side of the collar of said clothes, and inserting a keeper to the lower side of the front collar portion of said clothes.

* * * * *